US008128765B2

(12) United States Patent
Myneni et al.

(10) Patent No.: US 8,128,765 B2
(45) Date of Patent: Mar. 6, 2012

(54) LARGE GRAIN CAVITIES FROM PURE NIOBIUM INGOT

(75) Inventors: Ganapati Rao Myneni, Yorktown, VA (US); Peter Kneisel, Williamsburg, VA (US); Tadeu Cameiro, McMurray, PA (US)

(73) Assignee: Jefferson Science Associates, LLC, Newport, News, VA (US)

( * ) Notice: Subject to any disclaimer, the term of this patent is extended or adjusted under 35 U.S.C. 154(b) by 1704 days.

(21) Appl. No.: 11/099,247

(22) Filed: Apr. 5, 2005

(65) Prior Publication Data

US 2006/0219336 A1 Oct. 5, 2006

(51) Int. Cl.
*C22C 27/02* (2006.01)

(52) U.S. Cl. ..... 148/668; 148/422

(58) Field of Classification Search ..... 148/668, 148/422

See application file for complete search history.

(56) References Cited

U.S. PATENT DOCUMENTS

| | | | | |
|---|---|---|---|---|
| 3,493,809 | A * | 2/1970 | Weissman | 315/3.5 |
| 3,594,134 | A * | 7/1971 | Russell et al. | 428/596 |
| 6,863,750 | B2 * | 3/2005 | Michaluk et al. | 148/668 |

FOREIGN PATENT DOCUMENTS

| | | |
|---|---|---|
| JP | 03247745 | 5/1991 |

OTHER PUBLICATIONS

NPL: Niobium cavity development for the high-energy linac of the rare isotope accelerator, Proceedings of PAC 2001, 2001 IEEE, Chicago, pp. 1044-1046, thereafter NPL-2.*

Wikipedia—the free encyclopedia under term "slicing".*

M. Fouaidy, S. Bousson, J. Lesrel, S. M'Garrech IPN Orsay France, V. Palmeri, INFN Legnaro, Italy, "Tests Results of SRF 3 GHZ Bulk Niobium Spun Cavities", Proceedings of Epac2002, Paris, France pp. 2232-2234.

Dieter Proch, New Ways of Cavity Fabrication, Particle Accellerator, 1996, vol. 53, pp. 241-151.

Dieter Proch, Peter Schmueser, W. Singer and Lutz Lilje, "Niobium in Superconducting RF Cavities".

P. Kneisel, V. Palmeri, "Development of Seamless Niobium Cavities for Accellerator Applictions", Proceedings of 1999 Particle Accellerator Conference, N.Y. 1999.

* cited by examiner

*Primary Examiner* — Jie Yang

(57) ABSTRACT

Niobium cavities are fabricated by the drawing and ironing of as cast niobium ingot slices rather than from cold rolled niobium sheet. This method results in the production of niobium cavities having a minimum of grain boundaries at a significantly reduced cost as compared to the production of such structures from cold rolled sheet.

6 Claims, No Drawings

LARGE GRAIN CAVITIES FROM PURE NIOBIUM INGOT

The United States of America may have certain rights to this invention under Management and Operating Contract No. DE-AC05-84ER 40150 from the Department of Energy.

FIELD OF THE INVENTION

The present invention relates to the fabrication of niobium cavities for use in particle accelerators and the like apparatus and more particularly to a process of fabricating such cavities from slices of pure niobium ingot rather than niobium sheet material.

BACKGROUND OF THE INVENTION

In the prior art, niobium cavities of the type well known and used in the operation of particle accelerators and the like apparatus have been fabricated by drawing and ironing of niobium sheet produced by cold rolling and annealing ingot produced material. While such material has proven satisfactory for use in niobium cavities, the material thus produced exhibits several shortcomings principally related to grain size and grain size distribution. Cold roll sheet material, for example, exhibits a relatively fine grain structure and thus a plurality of grain boundaries that affect its performance in cavity operation. Cold rolled sheet also exhibits significant variation in grain size through and along the length of the sheet material which also affects its performance in cavities. Cast niobium on the other hand exhibits large grain size and relatively uniform grain size distribution through the body of the material. The presence of large grains results in a reduction in the number of grain boundaries and hence enhanced performance in the final cavity structure. Thus, if the relatively large and uniform grain size characteristics of the "as cast" or ingot niobium could be preserved in the formed cavity, performance would undoubtedly be improved.

In addition to the above described grain size related shortcomings of the prior art sheet material based cavities, there are other significant shortcomings associated with the use of cold rolled sheet material in the fabrication of niobium cavities. Among these are: 1) the costs associated with cold rolling and annealing of niobium to produce sheet are relatively high; 2) because of the relatively small grain sizes exhibited by cold rolled sheet materials, their strength when heated can be unacceptably reduced; and 3) cold rolled sheet demonstrates "memory" or "springback" characteristics that may require extensive and expensive finishing of the formed cavity after drawing and ironing to assure accurate dimensional characteristics. Such springback is due to the presence of banding or a lack of homogeniety of grain size in the cold rolled sheet. All of these shortcomings can be positively affected through the use of "as cast" ingot based niobium starting materials that possess large and relatively uniform grain size distributions.

OBJECTS OF THE INVENTION

It is therefor an object of the present invention to provide a method for fabricating niobium cavities that possess large grains and uniform grain distribution.

It is another object of the present invention to provide a method for fabricating niobium cavities at significantly reduced cost as compared to fabrication of such structures from cold rolled sheet.

SUMMARY OF THE INVENTION

According to the present invention, niobium cavities are fabricated by the drawing and ironing of as cast ingot slices.

This method results in the production of niobium cavities having a minimum of grain boundaries at a significantly reduced cost as compared to the production of such structures from cold rolled sheet.

DETAILED DESCRIPTION

As described hereinabove, in the prior art, niobium cavities have been fabricated by the drawing and ironing of cold rolled niobium sheet. Such a fabrication approach, while producing satisfactory cavities did not result in cavities that exhibited optimum operating characteristics, due in large part to the relatively small grain size and the relatively wide grain size distribution exhibited by such cold rolled niobium materials.

In an effort to improve the performance of such cavities a method was sought to find a fabrication technique that would provide a cavity that possessed relatively large grain size (or even single grain) with a concomitant reduction in the number of grain boundaries and also possessed a relatively uniform grain size distribution.

It has now been discovered that fabrication of cavities in the conventional fashion but using a starting material that comprises a sheet thickness slice of an ingot results in the fabrication of a cavities that exhibit the desirable grain size and grain size distribution characteristics properties. It quite surprisingly been found that cavities produced as described herein demonstrate superior thermal conductivity for thermal stability or RRR as referred to in the relevant prior art.

Thus, according to the method of the present invention, pure niobium is cast into an ingot, generally a round ingot of up to about 17 inches in diameter and up to or beyond 6 feet in length, and the ingot cut transversely, as described below, into slices between about 1/16 and 1/4 inch thick or about the thickness of the cold rolled sheet previously used in the prior art to fabricate such structures. The slices are preferably about 1/8 inch in thickness. The slices thus obtained are then used in the conventional drawing and ironing process to produce the desired half cells and the half cells thus produced further fabricated by machining and welding into cavities in the conventional fashion. Thus, the niobium cavities of the present invention comprise niobium having an essentially "as-cast" grain structure except as such "as-cast" grain structure may have been modified by cold work imparted thereto during the drawing and ironing process used to form the cavity halves. An objective in the development of the process described herein is to minimize the number of grains of niobium present in any single cavity half. Using the process described herein, the production of cavity halves comprising as few as one grain or crystal of niobium is possible, although most of the cavity halves produced as described herein will comprise upwards of two grains to perhaps as many as several hundred grains, but certainly fewer grains than the virtually unlimited number of grains of an about 50 micron size that are present in cavity halves fabricated from rolled sheet as described in the prior art.

The casting of niobium ingot is well known in the art and hence, no further description of this process is presented herein. For purposes of the present invention, conventionally cast pure niobium ingot is used. After casting, the ingot is sliced or cut transversely to yield a thin and round piece of niobium of the general size and shape of the cold rolled sheet commonly used for the production of cavities in the prior art. The "as cast" structure of the material from which the niobium cavities of the present invention are fabricated includes no grain structure imparted by hot or cold working of the metal (e.g. by hot or cold rolling) other than that which may be incidental to the cold work imparted to the metal during the drawing and ironing process to form the cavity halves. Thus, in the final cavity, the grain structure is essentially that which was present in the "as cast" ingot from which the ingot slice that is converted into the cavity half by drawing and ironing was cut.

Transverse slicing or cutting of the niobium ingot may be performed in any of a number of conventional fashions including EDM (electric discharge machining) or even conventional sawing with, for example, a band saw. Whatever method of cutting is used however, care must be taken to assure that the sliced or cut surfaces exhibit satisfactory smoothness for the subsequent drawing and ironing operation. In the case of EDM sliced material, the surfaces are relatively smooth, but in the case of conventional sawing the surfaces will be relatively rough and may require subsequent treatment either, for example by chemical etching, electro-polishing or some other suitable method. As is well known in the art, chemical etching can be accomplished through treatment of the surfaces with a mixture of hydrofluoric, nitric and phosphoric acids.

Once a satisfactorily smooth "sheet" produced by the slicing or cutting of the ingot and surface smoothing as just described has been obtained, it is processed in accordance with conventional and well known drawing and ironing, machining and welding processes to produce a finished cavity that exhibits the previously described enhanced properties.

There has thus been described a method for the production of large grain cavities from pure niobium ingot that involves the casting of pure niobium ingot, transversely slicing the ingot into slices of the approximate thickness of cold rolled niobium sheet and then drawing and ironing, machining and welding in accordance with conventional processing techniques to produce the enhanced niobium cavities of the present invention.

As the invention has been described, it will be apparent to those skilled in the art that the same may be varied in many ways without departing from the intended spirit and scope of the invention, and any and all such modifications are intended to be included within the scope of the appended claims.

What is claimed is:

1. A method for the production of niobium cavities comprising:

a) casting pure niobium ingot to form a large grain size cast niobium ingot;

b) transversely slicing the large grain size cast niobium ingot to form slices of large grain size cast niobium ingot;

c) drawing and ironing the slices of large grain size cast niobium ingot into cell halves with no subsequent heat treatment of any kind to yield cell halves that possess the large grain structure of the large grain size cast niobium ingot; and d) welding the cell halves together to form a cavity.

2. The method of claim 1 wherein the slices of cast niobium ingot are between about 1/16 and 1/4 inch thick.

3. The method of claim 2 wherein the slices of cast niobium ingot are between about 1/8 inch thick.

4. The method of claim 1 wherein the cutting is accomplished by electric discharge machining or sawing.

5. The method of claim 1 wherein the slices of cast niobium ingot have surfaces and the surfaces are smoothed prior to drawing and ironing.

6. The method of claim 5 wherein the smoothing is accomplished by chemical etching or electro-polishing.

* * * * *

UNITED STATES PATENT AND TRADEMARK OFFICE

CERTIFICATE OF CORRECTION

PATENT NO. : 8,128,765 B2
APPLICATION NO. : 11/099247
DATED : March 6, 2012
INVENTOR(S) : Ganapati Rao Myneni, Peter Kneisel and Tadeu Carneiro It is certified that error appears in the above-identified patent and that said Letters Patent is hereby corrected as shown below:

ON THE TITLE PAGE:

Item (75) Inventors: change “Tadeu Carmiero” to --Tadeu Carneiro--.

Signed and Sealed this
Fifteenth Day of May, 2012

David J. Kappos

David J. Kappos
*Director of the United States Patent and Trademark Office*